US008028746B2

(12) United States Patent
Cannas

(10) Patent No.: US 8,028,746 B2
(45) Date of Patent: Oct. 4, 2011

(54) HEAT EXCHANGER WITH FINNED TUBE AND METHOD OF PRODUCING THE SAME

(75) Inventor: Christian Cannas, Mandello Del Lario (IT)

(73) Assignee: Elbi International S.p.A., Turin (IT)

( * ) Notice: Subject to any disclaimer, the term of this patent is extended or adjusted under 35 U.S.C. 154(b) by 1054 days.

(21) Appl. No.: 11/702,172

(22) Filed: Feb. 5, 2007

(65) Prior Publication Data

US 2008/0186039 A1 Aug. 7, 2008

(51) Int. Cl.
*F28D 7/02* (2006.01)
*F28F 9/22* (2006.01)

(52) U.S. Cl. ..... 165/163; 165/156

(58) Field of Classification Search ..... 165/163, 165/156, 159, 160, 129, 130; 126/99 C; 122/18.4, 169, 247
See application file for complete search history.

(56) References Cited

U.S. PATENT DOCUMENTS

| | | | | | |
|---|---|---|---|---|---|
| 1,516,430 | A * | 11/1924 | Hess | 122/367.1 |
| 2,062,321 | A * | 12/1936 | Levin | 165/140 |
| 2,146,141 | A * | 2/1939 | Harris | 165/161 |
| 2,888,251 | A * | 5/1959 | Dalin | 165/74 |
| 3,875,759 | A * | 4/1975 | Malcosky et al. | 62/394 |
| 3,921,708 | A * | 11/1975 | Brenner | 165/84 |
| 6,293,335 | B1 * | 9/2001 | Tawney et al. | 165/156 |
| 7,686,072 | B2 | 3/2010 | Cannas | |
| 2008/0185131 | A1 | 8/2008 | Cannas | |

FOREIGN PATENT DOCUMENTS

| | | | |
|---|---|---|---|
| CH | 262895 | | 7/1949 |
| DE | 2248845 | | 4/1974 |
| DE | 19755095 | | 6/1998 |
| DE | 29823617 | | 11/1999 |
| EP | 1600708 | A1 | 11/2005 |
| EP | 1627190 | B1 | 2/2006 |
| EP | 1750069 | A1 | 2/2007 |
| EP | 1750070 | A1 | 2/2007 |
| EP | 1752718 | A1 | 2/2007 |
| FR | 1129717 | | 1/1957 |
| GB | 872255 | | 7/1961 |
| GB | 1114252 | | 5/1968 |
| WO | WO 2004/090434 | A1 | 10/2004 |

OTHER PUBLICATIONS

European Search Report mailed Dec. 27, 2005 in corresponding application No. 05107263.5-2301.

* cited by examiner

*Primary Examiner* — Tho V Duong
(74) *Attorney, Agent, or Firm* — Davidson Berquist Jackson & Gowdey, LLP

(57) ABSTRACT

A heat exchanger for a gas boiler for producing hot water is provided with a casing extending along a first axis and through which combustion fumes flow; a tube along which water flows, and which is housed inside the casing and coils about the first axis to form a helix made of a succession of turns; and deflecting means for directing the fumes between successive turns; the tube being provided with a first and a second fins, which extend along the length of the tube, face one another, and are tangent to the tube.

15 Claims, 2 Drawing Sheets

HEAT EXCHANGER WITH FINNED TUBE AND METHOD OF PRODUCING THE SAME

The present invention relates to a heat exchanger with finned tube.

More specifically, the present invention relates to a heat exchanger for a gas boiler for producing hot water.

BACKGROUND OF THE INVENTION

A gas boiler for producing hot water normally comprises a gas burner, and at least one heat exchanger through which combustion fumes and water flow. Some types of gas boilers, known as condensation boilers, condense the steam in the combustion fumes and transfer the latent heat in the fumes to the water. Condensation boilers are further divided into a first type, equipped with a first exchanger close to the burner, and a second exchanger for simply condensing the fumes; and a second type, equipped with only one heat exchanger which provides solely for thermal exchange along a first portion, and for both thermal exchange and fume condensation along a second portion.

A condensation or dual-function exchanger of the above type is disclosed in WO 2004/090434 and comprises a casing extending along a first axis and through which combustion fumes flow; a tube along which water flows, and which is housed inside said casing and coils about the first axis to form a helix comprising a succession of turns; and deflecting means for directing the fumes between successive turns in a first direction perpendicular to said first axis. The tube is finned with at least a first and second outward fins facing one another and extending along the length of the tube.

Even though the above identified heat exchanger proved to be extremely effective in term of heat exchange, has still the drawback that the distance between the first and second outward fins of adjacent turns cannot be freely selected to optimise the heat exchange because the convexity of the tube protruding from the outward fins imposes a limit to such a distance to let the fumes flow with an adequate speed.

SUMMARY OF THE INVENTION

It is an object of the present invention to provide a heat exchanger for a gas boiler for producing hot water, which further improves the heat exchange without imposing structural limitation to the design parameters.

According to the present invention, there is provided a heat exchanger characterized in that said first and second fins are tangent to said tube.

In this way, the distance between the fins of adjacent turns can be selected to optimise the heat exchange.

The present invention also relates to a method of producing a heat exchanger.

According to the present invention, there is provided a method of producing a heat exchanger, as claimed in the attached Claims.

BRIEF DESCRIPTION OF THE DRAWINGS

A number of non-limiting embodiments of the present invention will be described by way of example with reference to the accompanying drawings, in which.

Figures 3, 4, 5, 6, 7, 8:
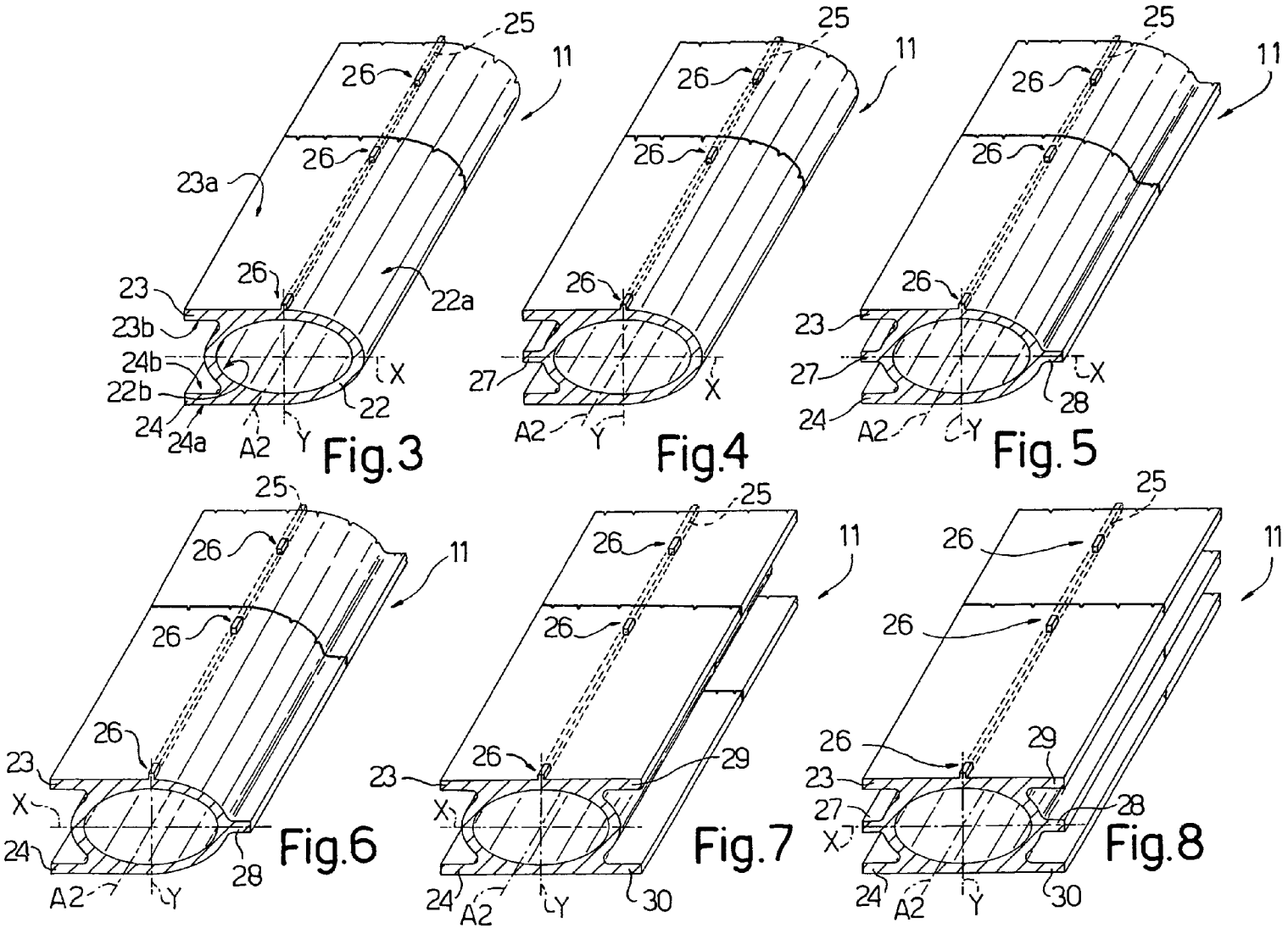
FIG. 3 shows a view in perspective of a tube used to produce the FIG. 1 exchanger.

Figures from 4 to 8 show variations of the tube of FIG. 3.

DETAILED DESCRIPTION OF THE INVENTION

Figure 1:
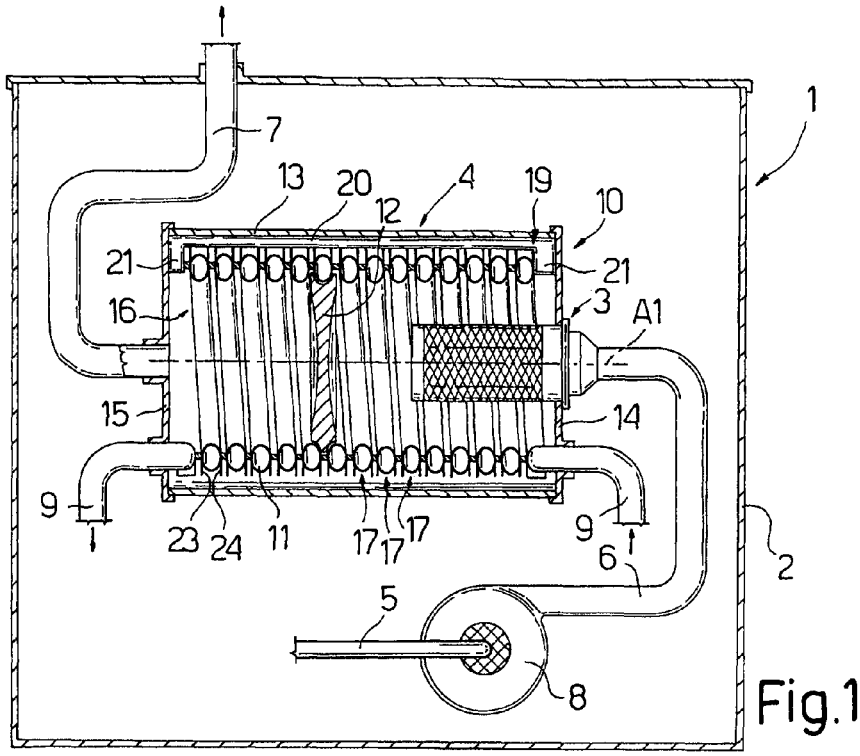
FIG. 1 shows a schematic front view, with parts in section and parts removed for clarity, of a gas boiler equipped with a heat exchanger in accordance with the present invention.

Number 1 in FIG. 1 indicates as a whole a gas boiler. Boiler 1 is a wall-mounted condensation boiler, i.e. in which the vapour in the combustion fumes is condensed, and comprises an outer structure 2 in which are housed a burner 3; a heat exchanger 4; a gas supply conduit 5; a pipe 6 for supplying an air-gas mixture to burner 3; a combustion gas exhaust pipe 7; a fan 8 connected to supply pipe 6, and which performs the dual function of supplying the air-gas mixture to burner 3, and expelling the combustion fumes; and a water circuit 9. Burner 3 is connected to pipe 6, is cylindrical in shape, and comprises a lateral wall with holes (not shown) for emitting the air-gas mixture and feeding the flame. Burner 3 is partially housed inside exchanger 4 which, in fact, also acts as a combustion chamber. Heat exchanger 4 is substantially cylindrical in shape, extends along a substantially horizontal axis A1, and comprises a casing 10, through which the combustion fumes flow; a finned tube 11, along which water flows; and a disk 12 for directing the fumes along a given path inside exchanger 4. Casing 10 comprises a cylindrical lateral wall 13 about axis A1; an annular wall 14 connected to lateral wall 13 and to burner 3; and an annular wall 15 connected to lateral wall 13 and to exhaust pipe 7. Burner 3 extends, coaxially with exchanger 4, inside of exchanger 4 for a given length. Tube 11 coils about axis A1 to form a helix 16 comprising a succession of adjacent turns 17, each located close to lateral wall 13, and has two opposite ends with known fittings (not shown) for connecting tube 11 to water circuit 9 outside exchanger 4. Disk 12 has a lateral helix-shaped edge 18 engaging turns 17. That is, disk 12 is screwed to turns 17 into the desired position along axis A1 and in a position substantially perpendicular to axis A1. An inwardly finned helix will require a disk with a differently shaped hedge to match with the shape of the fins.

Exchanger 4 comprises three spacers 19 for keeping turns 17 a given distance from lateral wall 13. Each spacer 19 comprises a straight portion 20 parallel to axis A1, and from which project two fingers 21 for clamping the helix 16 on opposite sides. Helix 16, disk 12, and spacers 19 define, inside casing 10, a region B1 housing burner 3; a region B2 communicating directly with, exhaust pipe 7; and three regions B3, each extending between two spacers 19, turns 17, and lateral wall 13. Combustion of the air-gas mixture takes place in region B1; and the resulting fumes, being prevented by disk 12 from flowing directly to region B2, flow between turns 17, in a direction D1 substantially perpendicular to axis A1, to regions B3, along which they flow in a direction D2 substantially parallel to axis A1. On reaching regions B3, the fumes flow between turns 17 in direction D3 to region B2 and then along exhaust pipe 7.

Tube 11 is preferably made of aluminium or aluminium-based alloy. With reference to FIG. 3, finned tube 11 is an extruded tube, which extends along an axis A2, and comprises an oval-section wall 22; two fins 23 and 24 on one side of tube 11. The cross section of tube 11 has a major axis X and a minor axis Y. Wall 22 is provided with an outer surface 22*a* and an inner surface 22*b* and has a constant thickness. Fins 23 and 24 are parallel to axis A2 of tube 14 and to major axis X, and are therefore parallel to one another and face one another. The maximum extension of fins 23 and 24, in a direction parallel to major axis X, is roughly a quarter of the length of major axis X. Fins 23 and 24 are tangent to the tube 11 and have a thickness equal to the thickness of wall 22 and are provided with respective outer surface 23*a* and 24*a*, which are tangent to outer surface 22*a*, and inner surface 23*b* and 24*b*, which are ideally tangent to the inner surface 22*b*.

Tube 11 is extruded with a longitudinal rib 25 (shown in dotted lines in FIG. 3) protruding from outer surface 22*a* at the intersection of wall 22 with minor axis Y. Rib 25 has a rectangular cross section and is partially machined to form a number of teeth 26 equally spaced along tube 11 for spacing adjacent turns 17.

Once extruded with fins 23, 24 and machined the rib 25, tube 11 is coiled about axis A1 to form helix 16. This operation actually comprises calendering tube 11, with the minor axis Y of the section of tube 14 maintained substantially parallel to axis A1. The relatively small size of fins 23 and 24 does not hinder the calendering operation, and does not call for notching fins 23 and 24. The three spacers 19 are clamped on the helix 16 and arranged 120 degrees apart, so as to form, with the coiled tube 11, an assembly which is inserted inside lateral wall 13 of casing 10. Annular walls 14 and 15 are then fitted to the opposite ends of cylindrical wall 13.

Figure 2:
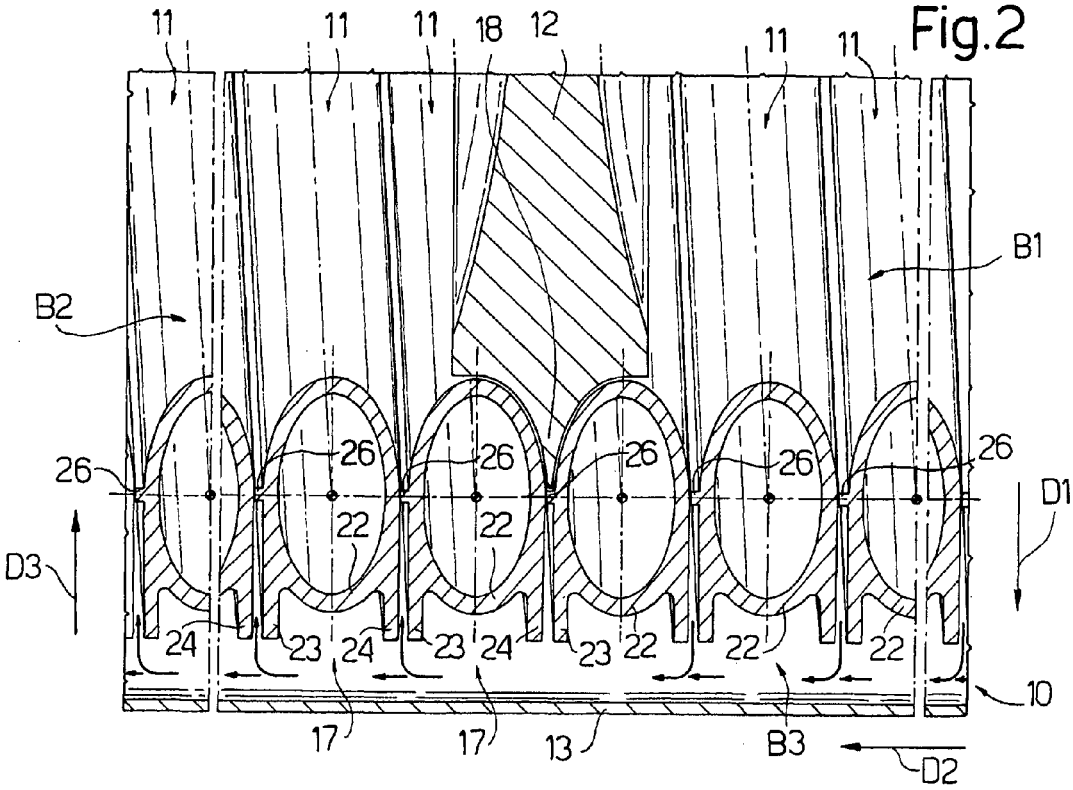
FIG. 2 shows a larger-scale section of a detail of the FIG. 1 heat exchanger.

Tube 11 is coiled with a constant pitch and radius, so that fins 23 and 24 of each turn 17 face and are parallel to fins 23 and 24 of the adjacent turns 17, as shown in FIG. 2. A gap is thus formed between each two adjacent turns 17, is of constant width at fins 23 and 24. The fumes flow from region B1 to regions B3 in direction D1 towards wall 13, then flow in direction D2 between turns 17 and wall 13, flow between turns 17 in direction D3 from regions B3 to region B2, and are finally expelled by exhaust pipe 7. The successive gaps between turns 17 therefore define compulsory fume paths.

The height of rib 25 may be selected to be equal to the most appropriate distance between adjacent turns 17 and their fins 23 and 24.

In FIG. 4 variation, tube 11 is provided with an additional fin 27 parallel to fins 23 and 24 to axes A1 and X and located between fins 23 and 24.

According to FIG. 5 variation, tube 11 is provided with additional fin 27 and additional fin 28 located opposite and coplanar to fin 27.

In FIG. 6 variation, tube 11 is provided with additional fin 28 only, whereas additional fin 27 is missing.

FIG. 7 variation shows a tube 11 provided with an additional fin 29, which is coplanar and opposite to fin 23, and additional fin 30, which is coplanar and opposite and coplanar to fin 24.

In FIG. 8 variation, tube 11 is provided with additional fin 29 and 30 tangent to the outer wall 22 of tube 11 and fins 27 and 28.

Exchanger 4 as described above may also be used in condensation boilers comprising a main exchanger, and in which exchanger 4 provides solely for condensing the fumes, as opposed to acting as a combustion chamber as in the example described.

The invention claimed is:

1. A heat exchanger for a gas boiler for producing hot water; the heat exchanger (4) comprising a casing (13) extending along a first axis (A1) and through which combustion fumes flow; a tube (11) along which water flows, and which is housed inside said casing (13) and coils about the first axis (A1) to form a helix (16) comprising a succession of turns (17); and deflecting means (12) for directing the fumes between successive turns (17); said tube (11) comprising at least a first and a second fins (23, 24) extending along the length of said tube (11) and facing one another; said heat exchanger being characterized in that said first and second fin (23, 24) are tangent to said tube (11).

2. A heat exchanger as claimed in claim 1, characterized in that the first and second fins (23, 24) are continuous with no interruptions.

3. A heat exchanger as claimed in claim 1, characterized in that the first and second fin (23, 24) are directed outwardly with respect to said first axis (A1).

4. A heat exchanger as claimed in claim 1, characterized in that the first and second fins (23, 24) of each turn (17) are parallel to and face the first and second fin (23, 24) respectively of an adjacent turn (19).

5. A heat exchanger as claimed in claim 1, characterized in that said tube (11) comprises a third and a fourth fins (29, 30) parallel to each other and facing one another; said third fin (29) being coplanar to said first fin (23) and said fourth fin (30) being coplanar with said second fin (24); said third and fourth fins (29, 30) being directed inwardly with respect to said first axis (A1).

6. A heat exchanger as claimed in claim 5, characterized in that said tube (11) comprises a fifth fin (27) parallel to the first and second fins (23, 24) and located in between the first and the second fins (23, 24) and directed outwardly with respect to the first and second fins (23, 24).

7. A heat exchanger as claimed in claim 6, characterized in that said tube (11) comprises a sixth fin (28) parallel to the first and the second fin (23, 24) and located between the first and second fin (23, 24) on the opposite side of the first and second fins (23, 24).

8. A heat exchanger as claimed in claim 1, characterized in that said tube (11) is provided with wall (22) having an oval cross section with a major axis (X) parallel to the first and second fin (23, 24), and a minor axis (Y) perpendicular to the first and second fin (23, 24).

9. A heat exchanger as claimed in claim 1, characterized by comprising spacers (19) for keeping said helix (16) a given distance apart from the casing (10) of the heat exchanger (4).

10. A heat exchanger as claimed in claim 1, characterized in that the tube (11) is provided with integrally made teeth (26) for spacing said turns (17) apart.

11. A method of producing the heat exchanger (4) claimed in claim 7, characterized by extruding said tube (11) and the first (23) and second (24) fins to form a straight, finned tube (14) in one extrusion operation.

12. A method as claimed in claim 11, characterized by extruding said tube (11) in one extrusion operation with said third and fourth fins (29, 30).

13. A method as claimed in claim 11, characterized by extruding said tube (11) with said fifth fin (27) in one extrusion operation.

14. A method as claimed in claim 11, characterized by extruding said tube (11) with said sixth fin (28) on one extrusion operation.

15. A method as claimed in claim 11, characterized by extruding said tube (11) with a continuous substantially radial rib (25) and partially machining said rib (25) so as to make teeth (26) for spacing said turns (17) apart once the tube (11) is coiled in a helix (16).

* * * * *